US009522301B2

(12) United States Patent
Orenstein

(10) Patent No.: US 9,522,301 B2
(45) Date of Patent: Dec. 20, 2016

(54) CURL-UP DEVICE

(71) Applicant: The Prophet Corporation, Owatonna, MN (US)

(72) Inventor: Amber Orenstein, Prior Lake, MN (US)

(73) Assignee: The Prophet Corporation, Owatonna, MN (US)

( * ) Notice: Subject to any disclaimer, the term of this patent is extended or adjusted under 35 U.S.C. 154(b) by 0 days.

(21) Appl. No.: 14/341,217

(22) Filed: Jul. 25, 2014

(65) Prior Publication Data

US 2016/0023041 A1 Jan. 28, 2016

(51) Int. Cl.

| | |
|---|---|
| ***A63B 26/00*** | (2006.01) |
| ***A63B 71/00*** | (2006.01) |
| ***A63B 23/02*** | (2006.01) |
| *A63B 71/02* | (2006.01) |

(52) U.S. Cl.

CPC ..... *A63B 23/0211* (2013.01); *A63B 2071/027* (2013.01); *A63B 2220/17* (2013.01); *A63B 2220/801* (2013.01)

(58) Field of Classification Search

CPC ..... A63B 23/00; A63B 23/02; A63B 23/0205; A63B 23/0211; A63B 23/0244; A63B 2220/00; A63B 2220/17

USPC ..... 482/1, 8, 140–142, 145, 148

See application file for complete search history.

(56) References Cited

U.S. PATENT DOCUMENTS 4,182,510 A * 1/1980 Lundell ..... A63B 23/0211 482/140
4,509,748 A * 4/1985 Bezak ..... A63B 23/0211 482/140
4,705,271 A * 11/1987 Mondloch ..... A63B 21/0083 482/112
5,098,089 A * 3/1992 Harrington ..... A63B 23/0211 482/140
5,300,004 A * 4/1994 Muehlenbein ..... A63B 23/0211 482/140
D349,316 S * 8/1994 Miller ..... D21/686
5,417,636 A * 5/1995 Havens ..... A63B 21/4037 482/140
8,016,726 B2 * 9/2011 Abiemo ..... A63B 23/0211 482/140
2002/0132703 A1 * 9/2002 Martinez ..... A63B 24/00 482/8
2007/0281840 A1 * 12/2007 Tsai ..... A63B 23/0211 482/140

(Continued)

OTHER PUBLICATIONS

Gopher Catalog (copyright 2012) (4 pages including the front cover, catalogue pages, and rear cover).

(Continued)

*Primary Examiner* — Stephen Crow
*Assistant Examiner* — Garrett Atkinson
(74) *Attorney, Agent, or Firm* — Merchant & Gould P.C.

(57) ABSTRACT

A curl-up device includes a base; and a counter arrangement. The base defines a foot placement indicator, a first start position indicator, and optionally a second start position indicator. The counter arrangement includes a button disposed between the foot placement indicator and the start position indicators. The counter arrangement also includes an electronic counter that tracks depression of the button. In use, a user touches the button while performing a curl-up to track the number of curl-ups performed.

20 Claims, 9 Drawing Sheets

(56) References Cited

U.S. PATENT DOCUMENTS

| | | | | |
|---|---|---|---|---|
| 2009/0298657 | A1* | 12/2009 | Potok | A63B 23/1245 482/141 |
| 2010/0197471 | A1* | 8/2010 | Hayes | A63B 6/00 482/140 |
| 2010/0255968 | A1* | 10/2010 | Jiang | A63B 23/0211 482/140 |
| 2011/0269600 | A1* | 11/2011 | Houle | A63B 23/0458 482/8 |

OTHER PUBLICATIONS

Gopher Catalog (copyright 2014) (6 pages including the front cover, index, catalogue pages, and rear cover).

* cited by examiner

CURL-UP DEVICE

BACKGROUND

Physical fitness is important for a healthy lifestyle. Accordingly, schools assess the physical fitness of their students (e.g., by participating in the President's Challenge). Curl-ups or partial curl-ups can be performed during such assessments. Conventionally, teachers or other designated testers used stop watches or hand-held timers to determine the number of curl-ups performed over a period of time. Observing each student perform the curl-ups can be time consuming. Alternatively, students being tested could track their own numbers.

Improvements are desired.

SUMMARY

In accordance with some aspects of the disclosure, a curl-up device includes a counter arrangement disposed on a base. The base defines a foot placement section and an elongated strip extending outwardly from the foot placement section in a first direction. The elongated strip defines a start position indicator that is fixed in place relative to the base. The counter arrangement includes a pressure-sensitive element (e.g., a button) disposed between the foot placement indicator and the start position indicator. The pressure-sensitive element faces in the first direction towards the start position indicator. The counter arrangement also includes a counter that tracks depression of the pressure-sensitive element.

In certain implementations, the start position indicator includes a raised bar. In an example, the raised bar extends across a full width of the elongated strip.

In certain implementations, the elongated strip also defines a second start indicator that is offset from the start indicator along the first direction.

In certain examples, the pressure-sensitive element is vertically oriented.

In certain implementations, the counter arrangement includes a housing to which the pressure-sensitive element and counter are coupled. In certain examples, the housing is removably coupled to the base. In certain examples, the base defines a recessed surface at which the housing is coupled to the base. In certain examples, the pressure-sensitive element extends across a majority of a width of the housing.

In certain implementations, a stop member extends upwardly from the base to inhibit movement of the counter arrangement relative to the base in a direction opposite the first direction. In an example, the stop member extends upwardly from the elongated strip.

In certain implementations, the elongated strip extends from a first side of the foot placement section and a second elongated strip extends from an opposite second side of the foot placement section. In certain examples, the second elongated strip also defines a start position indicator that laterally aligns with the start position indicator of the elongated strip.

In accordance with other aspects of the disclosure, a method of assessing physical fitness includes (a) sitting on a surface behind an curl-up device; (b) placing feet on a foot placement section of the curl-up device; (c) placing fingertips at an indicator start position on the curl-up device; and (d) performing a curl-up including touching a rearwardly facing pressure-sensitive element disposed on the curl-up device at a height of the curl-up.

In some examples, steps (c) and (d) of the method are repeated for a time duration. In other examples, steps (c) and (d) of the method are repeated until a particular number of curl-ups has been performed.

In certain implementations, the method includes viewing a number of curl-ups performed on a display screen.

In accordance with other aspects of the disclosure, a curl-up device includes a base having a front and a rear, and a counter arrangement including a housing that removably couples to the base. The base includes a generally flat foot placement pad configured to seat on a surface, a first elongated strip extending rearwardly from the foot placement pad to a first free end, and a second elongated strip extending rearwardly from the foot placement pad to a second free end. The first elongated strip defines at least a first start position indicator; and the second elongated strip defines a least a first start position indicator that laterally aligns with the first start position indicator of the first elongated strip. The first and second elongated strips define a space therebetween at which a user can sit. The counter arrangement includes a rearwardly-facing pressure-sensitive element and a control unit operably coupled to the rearwardly-facing pressure-sensitive element. The control unit is configured to count a number of actuations of the rearwardly-facing pressure-sensitive element and to indicate the number of actuations to the user.

A variety of additional inventive aspects will be set forth in the description that follows. The inventive aspects can relate to individual features and to combinations of features. It is to be understood that both the forgoing general description and the following detailed description are exemplary and explanatory only and are not restrictive of the broad inventive concepts upon which the embodiments disclosed herein are based.

BRIEF DESCRIPTION OF THE DRAWINGS

The accompanying drawings, which are incorporated in and constitute a part of the description, illustrate several aspects of the present disclosure. A brief description of the drawings is as follows.

DETAILED DESCRIPTION

Figure 1:
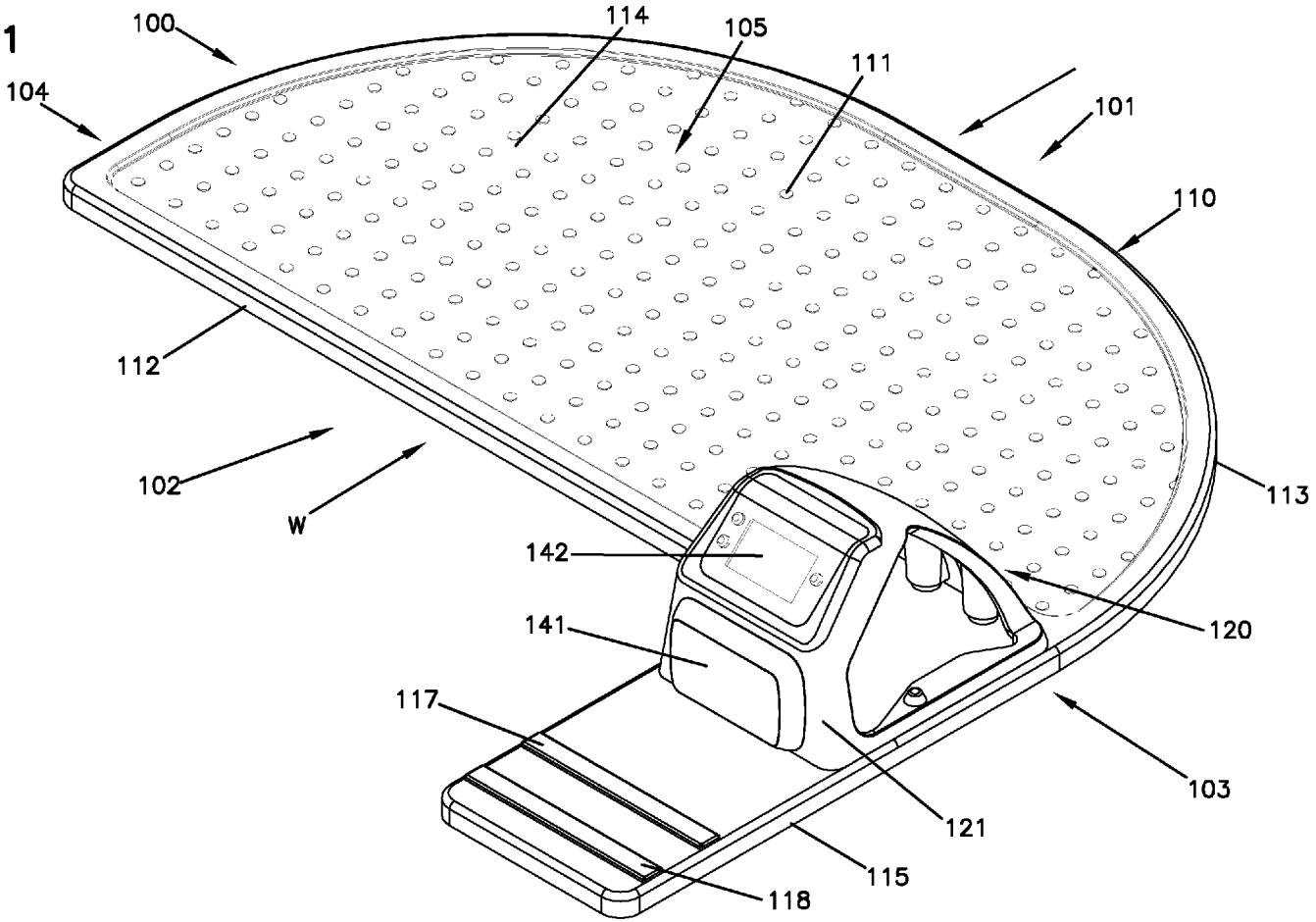
FIG. 1 is a top perspective view of an example curl-up device including a counter arrangement disposed at a base.
Figure 2:
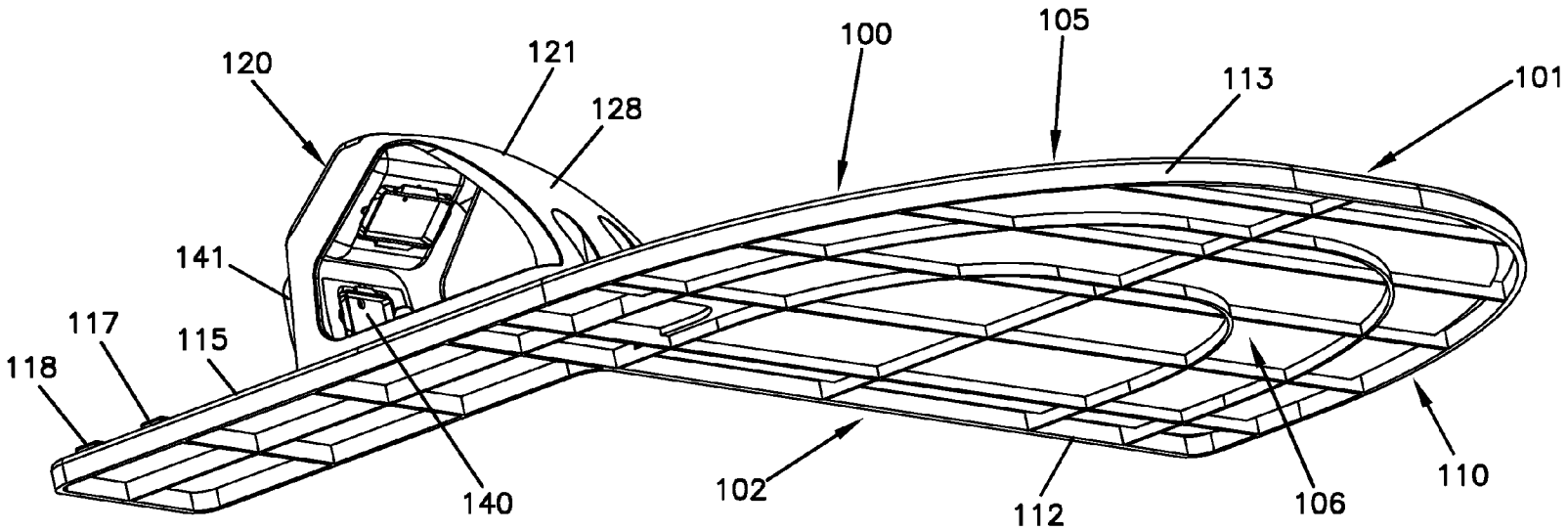
FIG. 2 is a bottom perspective view of the curl-up device of FIG. 1.
Figure 3:
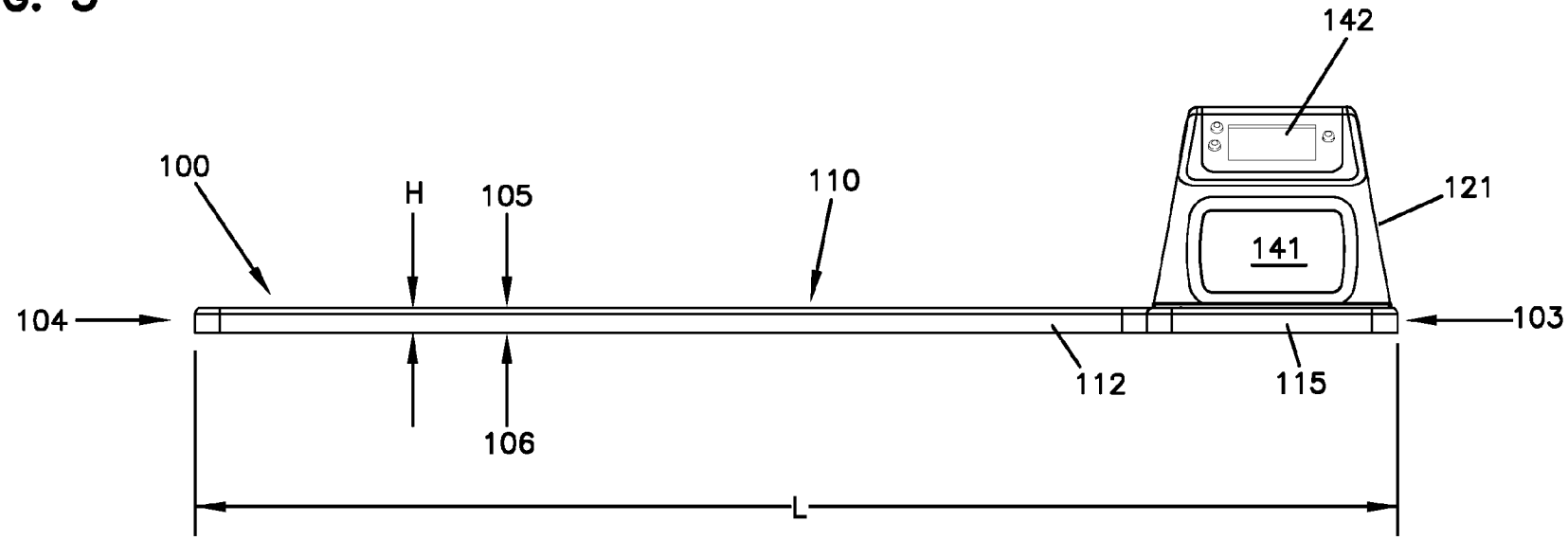
FIG. 3 is a rear elevational view of the curl-up device of FIG. 1.

Reference will now be made in detail to exemplary aspects of the present disclosure that are illustrated in the accompanying drawings. Wherever possible, the same reference numbers will be used throughout the drawings to refer to the same or like parts.

In general, the disclosure relates to a curl-up device that is configured to facilitate exercise and/or to facilitate a physical fitness assessment of a user. In particular, the curl-up device tracks a number of curl-ups performed by a user. As the term is used herein, a curl-up can refer to a curl-up, a partial curl-up, a sit-up, or any other abdominal exercise that includes raising a trunk of the user from a substantially prone position. The curl-up device includes a counter arrangement coupled to a base pad. The base pad provides a foot placement indicator and a finger start position indicator. The counter arrangement includes a pressure-sensitive element (e.g., a button) offset from the finger start position indicator. The counter arrangement also includes an electronic counter that tracks depression of the pressure-sensitive element.

FIGS. 1-4 illustrates an example curl-up device 100 having a front 101, a rear 102, a first side 103, a second side 104, a top 105, and a bottom 106. The curl-up device 100 includes a base 110 and a counter arrangement 120 mounted to the base 110. The base 110 is configured to be laid on a floor or other surface on which a user may sit or lay. The base 110 includes a main section 111 from which an elongated strip 115 rearwardly extends.

A first position indicator 117 is disposed on the elongated strip 115. In some examples, a second position indicator 118 also is disposed on the elongated strip 115 at a location rearwardly offset from the first position indicator 117. In the example shown, the first and second position indicators 117, 118 each include a raised bar extending fully across the elongated strip 115. In other examples, one or both of the position indicators 117, 118 can include a raised bar extending partially across the elongated strip 115, a different raised structure, a depression, a score line, or another such structural feature.

A counter arrangement 120 is coupled to the base 110 at a location between the main section 111 and the position indicators 117, 118. The counter arrangement 120 includes a housing 121 holding an electronic counter 140 (FIG. 2) and a button 141 (FIG. 1) operationally coupled to the electronic counter 140. In other examples, however, the counter 140 can track actuation of another type of triggering element. The electronic counter 140 tracks the number of times the button 141 is depressed (or otherwise actuated). The button 141 faces towards the rear 102 of the curl-up device 100. In certain examples, the counter arrangement 120 is configured to indicate (e.g., visually, audibly, etc.) when the button 141 is depressed or otherwise actuated.

The first position indicator 117 is positioned a first distance D1 (FIG. 7) from the button 141. The second position indicator 118 is positioned a second distance D2 (FIG. 7) from the button 141 that is larger than the distance D1. In some implementations, the first distance D1 is greater than about two inches and the second distance D2 is greater than about four inches. In some implementations, the first distance D1 is less than about four inches and the second distance D2 is less than about six inches. In some implementations, the first distance D1 ranges from about two inches to about four inches. In certain examples, the first distance D1 ranges from about 2.5 inches to about 3.5 inches. In one example, the first distance D1 is about three inches. In some implementations, the second distance D2 ranges from about three inches to about six inches. In certain examples, the second distance D2 ranges from about four inches to about five inches. In one example, the second distance D2 is about 4.5 inches.

Figure 5:
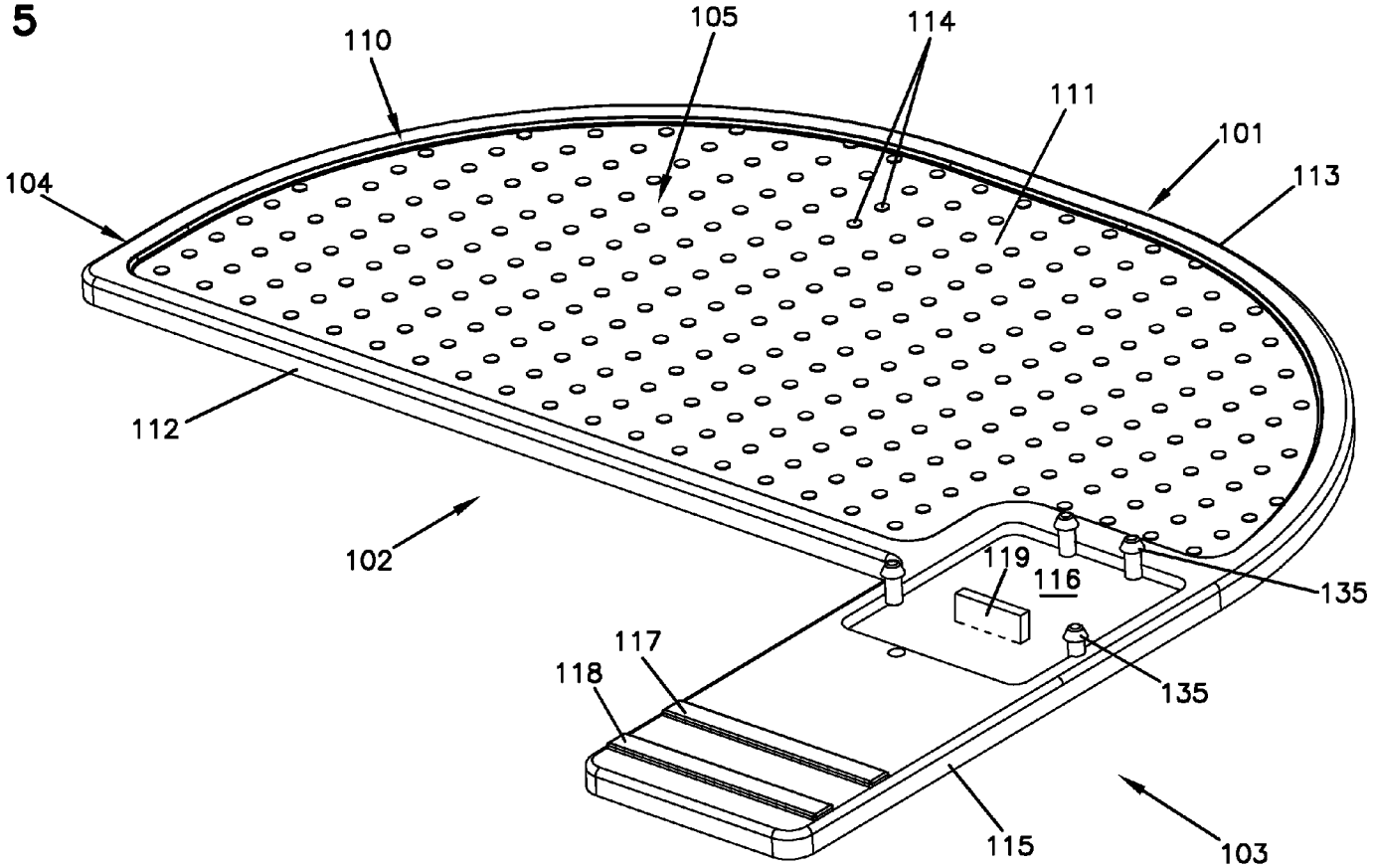
FIG. 5 is a top perspective view of an example base suitable for the curl-up device of FIG. 1.

FIG. 5 illustrates an example base 110 suitable for use in the curl-up device 100. The base 110 is generally flat in that a height H (FIG. 3) of the base 110, which extends between the top 105 and the bottom 106, is substantially smaller than a length L (FIG. 3), which extends between the first side 103 and the second side 104, and is substantially smaller than a width W (FIG. 1), which extends between the front 101 and the rear 102.

The main section 111 of the base 110 defines a foot placement section 112. In some implementations, the foot placement section 112 has a textured surface 114. In other implementations, the foot placement section 112 has a smooth surface. In some implementations, the foot placement section 112 is surrounded by a raised edge 113. In other examples, the foot placement section 112 is raised over the surrounding edge 113 of the main section 111.

In some implementations, the main section 111 also defines a recess 116 shaped to receive the counter arrangement 120. In other implementations, the elongated strip 115 defines the recess 116. In the example shown, the main section 111 and the elongated strip 115 cooperate to define the recess 116. In other implementations, the elongated strip 115 is flush with the edge 113 of the foot placement section 112. In certain implementations, a stop member 119 extends upwardly from the recess 116. In other implementations, the stop member 119 extends upwardly from a non-recessed section of the elongated strip 115.

In some implementations, the elongated strip 115 extends rearwardly from the rear 102 of the main section 111 at the first side 103. In the example shown, the main section 111 is generally straight at the rear 102 and generally contoured at the front 101 to form a semi-elliptical or semi-circular profile. In other examples, the main section 111 can be any desired shape (e.g., round, rectangular, quadrilateral, etc.). In the example shown, one side of the elongated strip 115 is continuous with the contoured surface of the main section 111 and the opposite side of the elongated strip 115 extends rearwardly from the straight rear side 102 of the main section 111.

Figure 6:
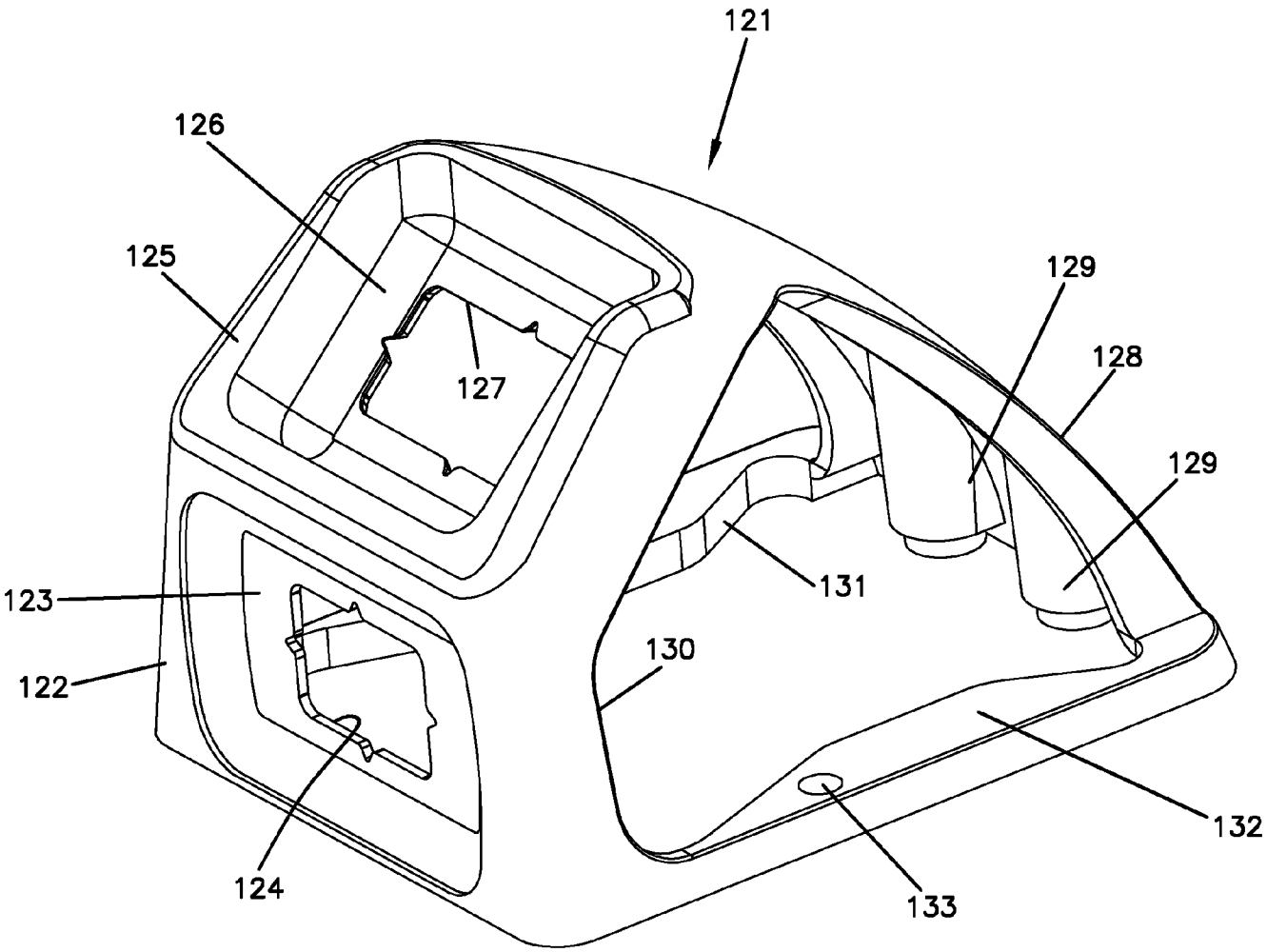
FIG. 6 is a top perspective view of an example counter housing of a counter arrangement suitable for the curl-up device of FIG. 1.

FIG. 6 illustrates an example counter housing 121 configured to mount to the base 110. In certain examples, the counter housing 121 is configured to removably mount to the base 110. For example, in certain implementations, the counter housing 121 may define one or more fastener openings 133 that are configured to receive a corresponding number of fastener posts to releasably lock the housing 121 to the base. In other examples, the posts 135 can latch, friction-fit, or otherwise secure to the counter housing 121. In other examples, the counter housing 121 may define one or more downwardly extending posts that fit into openings defined in the base 110. In still other examples, the counter housing 121 can be otherwise secured to the base 110.

Figure 4:
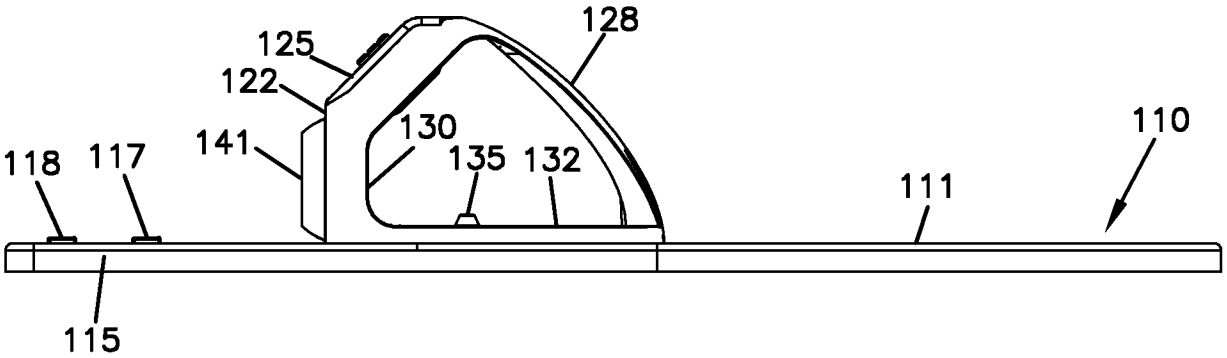
FIG. 4 is a side elevational view of the curl-up device of FIG. 1.

The counter housing 121 is configured to retain the counter 140 and the button 141 or other triggering mechanism. The counter housing 121 is configured to orient the button 141 to face rearwardly and to orient a display screen 142 to face upwardly and rearwardly. As shown in FIG. 4, the counter housing 121 orients the button 141 generally vertically when the counter housing 121 is mounted to the base 110.

The counter housing 121 has a first section 122 that defines a first pocket 123 at which the button 141 can be disposed. In certain examples, the counter 140 also can be disposed at the first pocket 123. The first pocket 123 may define a first aperture 124 to provide access to a battery compartment of the counter 140. The counter housing 121 also has a second section 125 that extends upwardly from the first section 122. In certain examples, the second section 125 is angled relative to the first section 122. The second section 125 defines a second pocket 126 at which a display screen 142 can be disposed. In certain examples, the second pocket 126 also can define a second aperture 127 through which a battery compartment of the display screen 142 can be accessed.

A support section 128 extends downwardly from the second section 125. In certain examples, the support section 128 curves downwardly from the top 105 of the second section 125. In certain examples, the support section 128 includes one or more reinforcing columns or other reinforcing structures 129. Mounting flanges 132 extend between the support section 128 and the first section 122 to define an open interior of the counter housing 121. In certain examples, the mounting flanges 132 define fastener openings 133. In an example, the reinforcing structures 129 also define fastener openings 133. In certain examples, open sides 130 are defined between the first section 122, second section 125, and support section 128.

In some implementations, the counter housing 121 is generally flexible, allowing the sections 122, 125, 128 to move relative to each other. Such flexibility facilitates battery replacement at the counter 140 and/or the display screen 142. In use, the stop member 119 of the base 110 provides a physical impediment to inhibit forward movement of the button 141 and/or counter 140 relative to the base 110 during actuation of the button 141. In certain implementations, the first section 122, the support section 128, and the mounting flanges 132 define an open bottom 131 therebetween. In such implementations, the stop member 119 extends upwardly from the base 110 through the open bottom 131 adjacent the first section 122. In certain examples, the counter housing 121 is mounted within a recess 116 so that surrounding edges of the base 110 inhibit forward or lateral movement of the counter housing 121 relative to the base 110.

Figure 7:
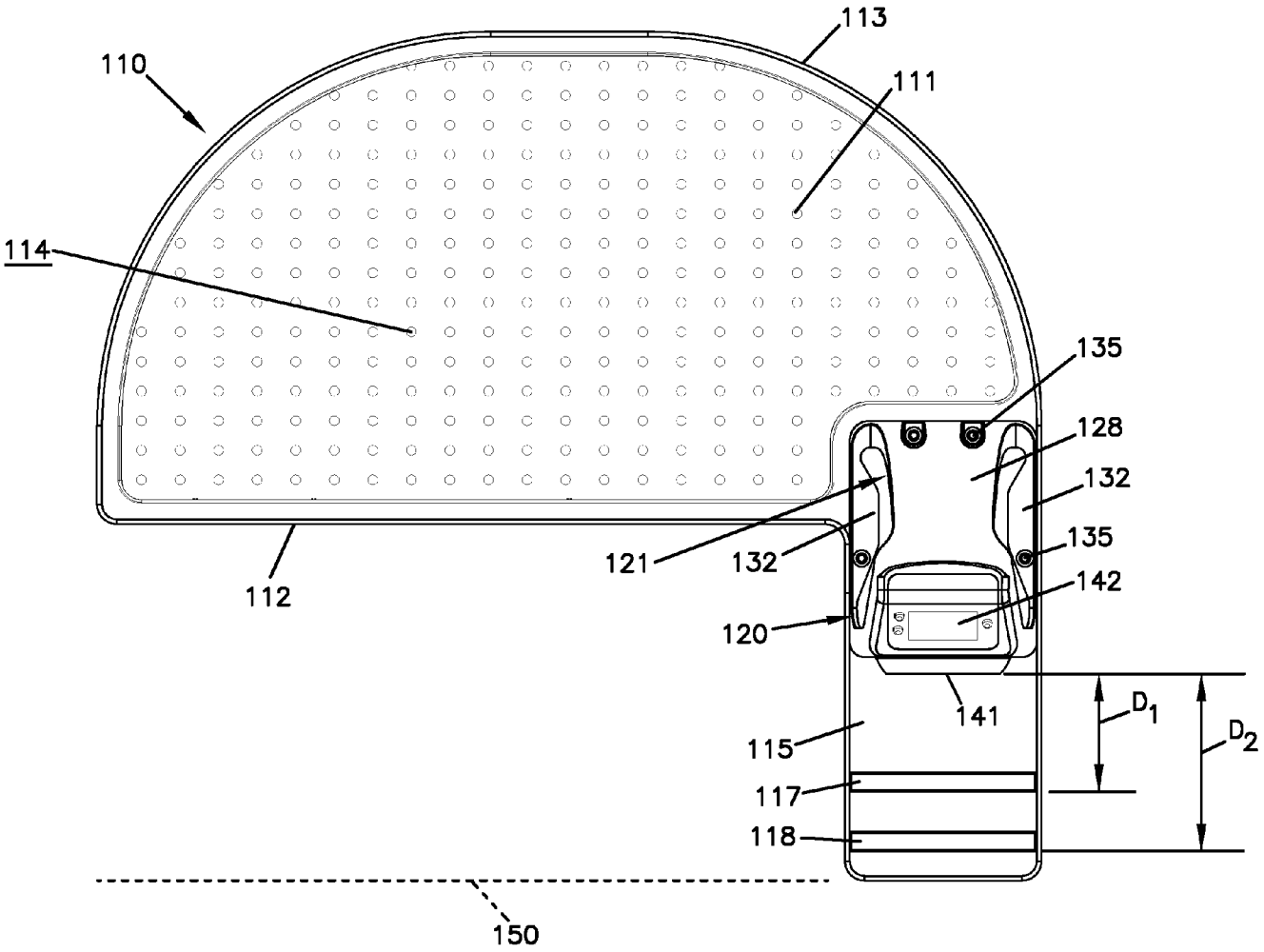
FIG. 7 is a top plan view of the curl-up device of FIG. 1.
Figure 8:
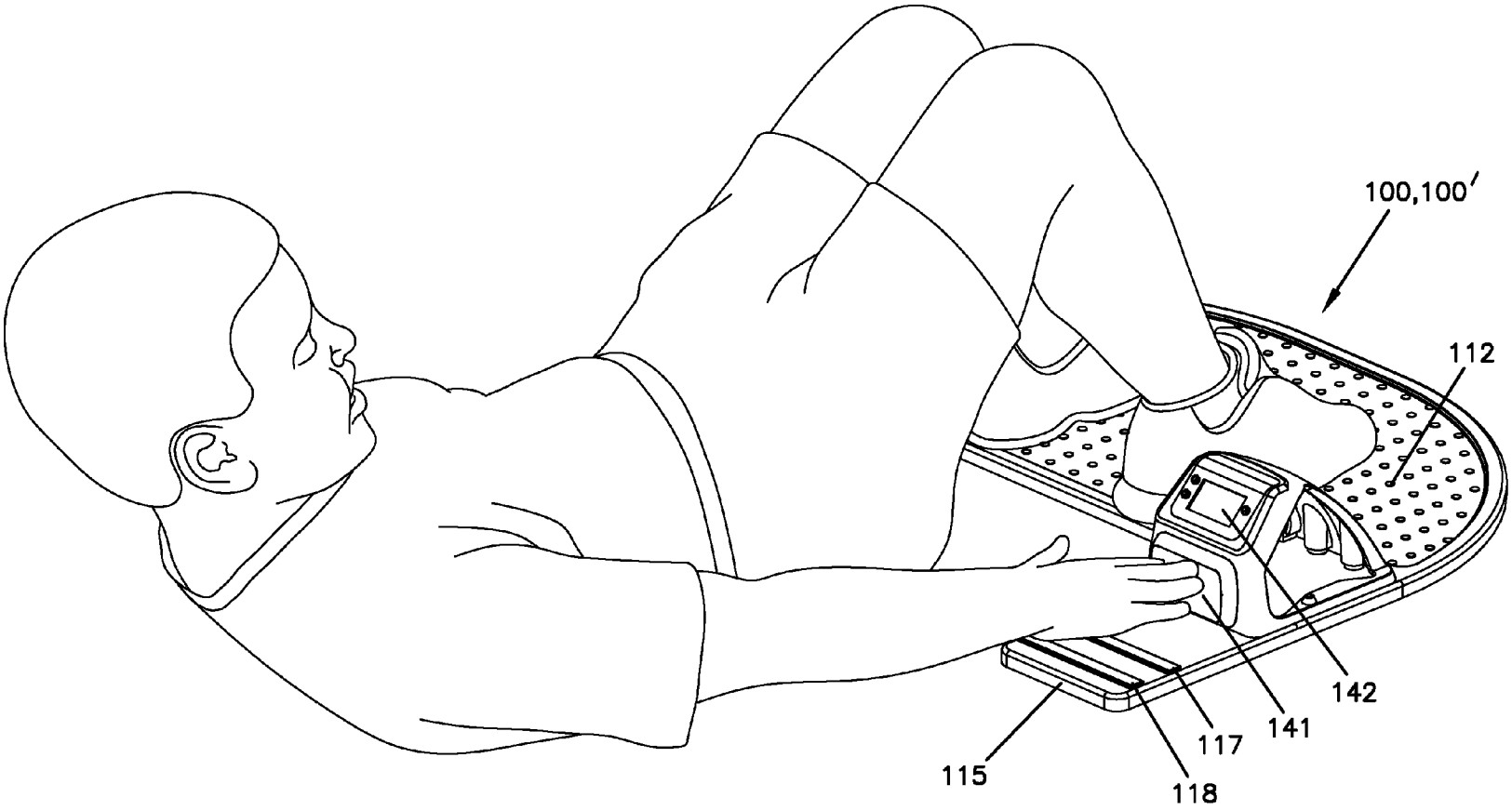
FIG. 8 is a perspective view of a user utilizing the curl-up device of FIG. 1.

Referring to FIGS. 7-8, the curl-up device 100 can be used to monitor the number of curl-ups that a user performs during an operation cycle or time period. In use, a user sits at a location 150 (FIG. 7) that is rearwardly offset from the main section 111 of the base 110 (see FIG. 8). Accordingly, the bottom and/or back of the user are not lying on top of the base 110 or other portion of the curl-up device 100. The feet of the user are positioned on the foot placement section 112 of the base 110 (FIG. 8). In certain examples, the user sits so that a bottom of the user is spaced about twelve inches from the heels of the user. It will be understood, however, that the curl-up can be performed according to the standards of the testing being performed. The fingertips of the user are positioned at either the first position indicator 117 or the second position indicator 118 (depending on the age, height, or other characteristic of the user). When performing the curl-up, the user touches, depresses, or otherwise actuates the button 141 to trigger the counter 140 (see FIG. 8).

Figure 9:
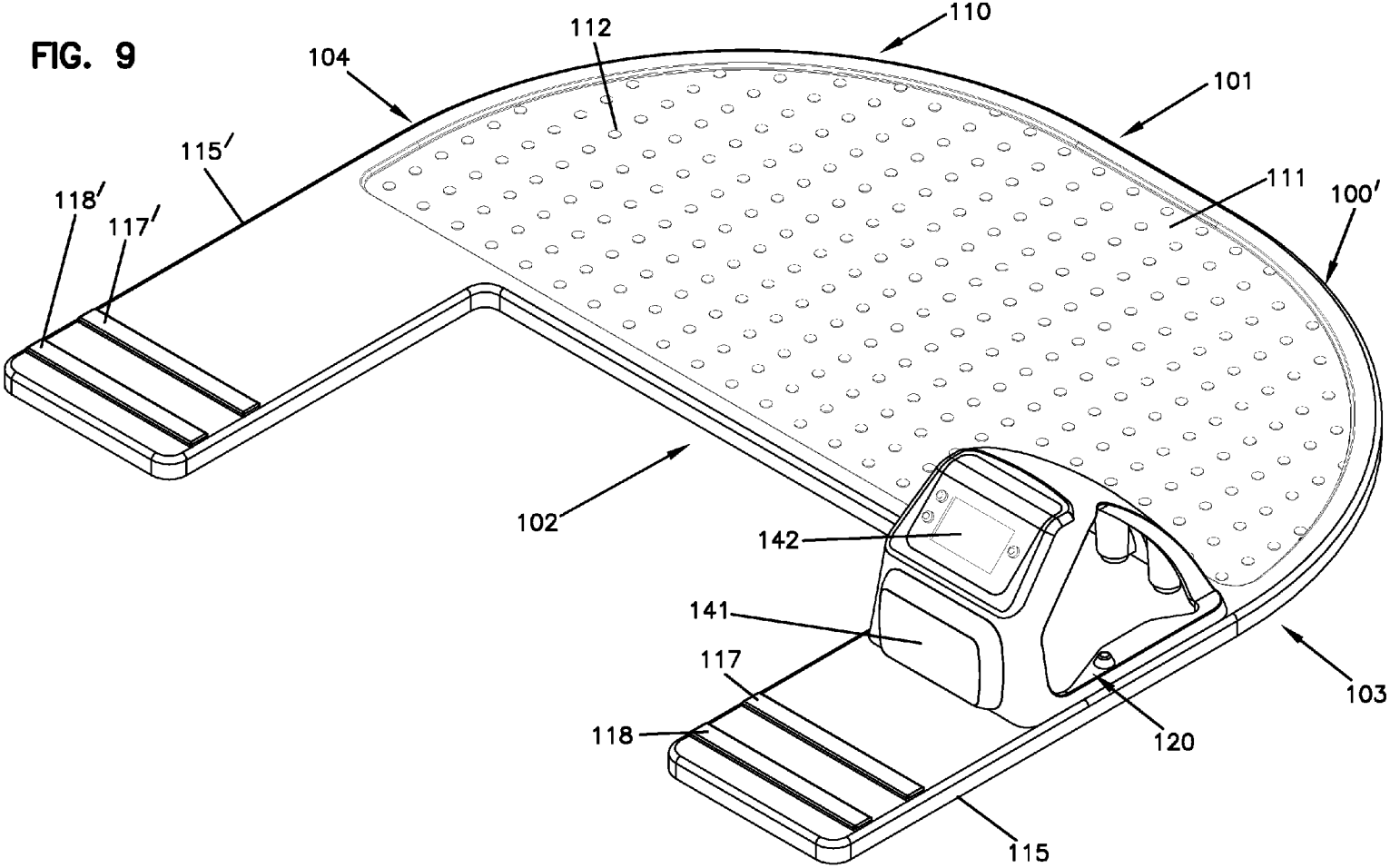
FIG. 9 is a top perspective view of another example curl-up device including a counter arrangement disposed at a base indicating a starting position for both hands of a user.

FIG. 9 illustrates another example curl-up device 100' that is substantially similar to the curl-up device 100 described above, except that the curl-up device 100' includes a second elongated strip 115'. In some implementations, first and/or second position indicators 117', 118' are disposed at the second elongated strip 115'. In certain implementations, the first position indicator 117' of the second strip 115' laterally aligns with the first position indicator 117 of the elongated strip 115; and the second position indicator 118' of the second strip 115' laterally aligns with the second position indicator 118 of the elongated strip 115.

During use, the fingertips of one hand of the user are positioned at either the first position indicator 117 or the second position indicator 118 (depending on the age, height, or other characteristic of the user) and the fingertips of the other hand of the user are positioned at the corresponding position indicator 117', 118' of the second elongated strip 115'. Accordingly, the second strip 115' can aid the user in maintaining proper form while performing curl-ups.

In the example shown, the elongated strip 115 extends rearwardly from the first side 103 of the main section 111 and the second elongated strip 115' extends rearwardly from the second side 104 of the main section 111. In certain examples, the elongated strips 115, 115' and the main section 111 define an empty space therebetween in which the user can sit. In other examples, the user can sit outside of the empty space.

In some implementations, the counter arrangement 120 is only disposed at the elongated strip 115 and not at the second elongated strip 115'. In other implementations, a second button 141 can be disposed at the second elongated strip 115'. In certain examples, a second counter can be disposed at the second elongated strip 115'. In still other implementations, an indicator surface (e.g., a vertical surface) can be provided at the second elongated strip 115' to indicate where the fingers of the user should touch during the height of the curl-up.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A curl-up device comprising:

a base defining a foot placement section extending between a front and a rear, the base also defining a portion extending rearwardly in a first direction from the rear of the foot placement section to a free end that is spaced rearwardly from the rear of the foot placement section to define an elongated strip that is elongated in the first direction, the rear of the foot placement section and the elongated strip partially bounding an area in which a user may sit, the elongated strip defining a start position indicator that is fixed in place relative to the base; and a counter arrangement disposed at the base, the counter arrangement including a button spaced from the foot placement section along the elongated strip, the button being disposed between the foot placement section and the start position indicator, the button facing in the first direction towards the start position indicator, the counter arrangement also including a counter that tracks depression of the button.

2. The curl-up device of claim 1, wherein the start position indicator includes a raised bar.

3. The curl-up device of claim 2, wherein the raised bar extends across a full width of the elongated strip.

4. The curl-up device of claim 1, wherein the elongated strip also defines a second start indicator that is offset from the start indicator along the first direction.

5. The curl-up device of claim 1, wherein the button is vertically oriented.

6. The curl-up device of claim 1, wherein the counter arrangement includes a housing to which the button and counter are coupled.

7. The curl-up device of claim 6, wherein the housing is removably coupled to the base.

8. The curl-up device of claim 6, wherein the base defines a recessed surface at which the housing is coupled to the base.

9. The curl-up device of claim 6, wherein the button extends across a majority of a width of the housing.

10. The curl-up device of claim 1, further comprising a stop member extending upwardly from the base to inhibit movement of the counter arrangement relative to the base in a direction opposite the first direction.

11. The curl-up device of claim 10, wherein the stop member extends upwardly from the elongated strip.

12. The curl-up device of claim 1, wherein the elongated strip extends from the rear of the foot placement section at a first side of the foot placement section; and wherein a second elongated strip extends from the rear of the foot placement section at an opposite second side of the foot placement section.

13. The curl-up device of claim 12, wherein the second elongated strip also defines a start position indicator that laterally aligns with the start position indicator of the elongated strip.

14. A method of assessing physical fitness using a curl-up device having a front and a rear, the method comprising:

(a) positioning the curl-up device on a surface, the curl-up device including: a base defining a foot placement section extending between a front and a rear, the base also defining a portion extending rearwardly in a first direction from the rear of the foot placement section to a free end that is spaced rearwardly from the rear of the foot placement section to define an elongated strip that is elongated in the first direction, the rear of the foot placement section and the elongated strip partially bounding an area in which a user may sit, the elongated strip defining a start position indicator that is fixed in place relative to the base; and a counter arrangement disposed at the base, the counter arrangement including a button spaced from the foot placement section along the elongated strip, the button being disposed between the foot placement section and the start position indicator, the button facing in the first direction towards the start position indicator, the counter arrangement also including a counter that tracks depression of the button;

(b) sitting on the surface at a location rearward of the rear of the foot placement section of the curl-up device;

(c) placing feet on the foot placement section of the curl-up device while the feet are placed on the foot placement section;

(d) placing fingertips at the start position indicator on the curl-up device while the feet are placed on the foot placement section; and (e) performing a curl-up including moving the fingertips forwardly relative to the curl-up device from the start position indicator towards a rearwardly facing button disposed on the curl-up device and touching the rearwardly facing button disposed on the curl-up device at a height of the curl-up.

15. The method of claim 14, wherein steps (c) and (d) of the method are repeated for a time duration.

16. The method of claim 14, wherein steps (c) and (d) of the method are repeated until a particular number of curl-ups has been performed.

17. The method of claim 14, further comprising viewing a number of curl-ups performed on a display screen.

18. A curl-up device comprising:

a base having a front and a rear, the base including:

a generally flat foot placement pad configured to seat on a surface, the foot placement pad extending between a front and a rear;

a first elongated strip extending rearwardly from the rear of the foot placement pad to a first free end that is spaced rearwardly from the rear of the foot placement pad, the first elongated strip defining at least a first start position indicator;

a second elongated strip extending rearwardly from the rear of the foot placement pad to a second free end that is spaced rearwardly from the rear of the foot placement the second elongated strip defining a least a first start position indicator that laterally aligns with the first start position indicator of the first elongated strip, the first and second elongated strips defining a space therebetween at which a user may sit; and a counter arrangement including a housing that removably couples to the base, the counter arrangement including a rearwardly-facing button and a control unit operably coupled to the rearwardly-facing button, the control unit being configured to count a number of actuations of the rearwardly-facing button and to indicate the number of actuations to the user.

19. The curl-up device of claim 18, wherein each of the elongated strips includes a second start position indicator that is offset from the respective first start position indicator.

20. The curl-up device of claim 18, wherein the first start position indicators include raised bars extending across widths of the respective elongated strips.

* * * * *